US006618931B2

(12) United States Patent
Takeda et al.

(10) Patent No.: US 6,618,931 B2
(45) Date of Patent: Sep. 16, 2003

(54) APPARATUS FOR ALIGNING SCROLL COMPRESSOR

(75) Inventors: Shuji Takeda, Kawasaki (JP); Makoto Araki, Kawasaki (JP); Kenji Shimura, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/931,941

(22) Filed: Aug. 20, 2001

(65) Prior Publication Data

US 2002/0062560 A1 May 30, 2002

(30) Foreign Application Priority Data

Aug. 25, 2000 (JP) ..... 2000-255366

(51) Int. Cl.[7] ..... B23P 15/00

(52) U.S. Cl. ..... 29/707; 29/705; 29/720; 29/888.022; 29/464

(58) Field of Search ..... 29/888.022, 467, 29/468, 464, 705, 707, 720; 418/55.1, 55.2

(56) References Cited

U.S. PATENT DOCUMENTS

| | | | | | |
|---|---|---|---|---|---|
| 4,584,750 | A | * | 4/1986 | Ozu et al. | 29/888.025 |
| 4,649,611 | A | * | 3/1987 | Ikeda et al. | 29/888.022 |
| 4,940,396 | A | * | 7/1990 | Shimizu et al. | 417/410.5 |
| 5,042,150 | A | * | 8/1991 | Fraser, Jr. | 29/888.022 |
| 5,984,653 | A | * | 11/1999 | Misiak | 418/55.1 |
| 6,247,910 | B1 | * | 6/2001 | Yokoyama | 418/55.1 |
| 2002/0062560 | A1 | * | 5/2002 | Takeda et al. | 29/888.022 |

* cited by examiner

*Primary Examiner*—I Cuda Rosenbaum
(74) *Attorney, Agent, or Firm*—Kanesaka & Takeuchi

(57) ABSTRACT

There are provided a fixed-scroll moveable device which is capable of moving a fixed-scroll of a scroll compressor in the directions of an X axis and a Y axis, and an orbiting-scroll revolution compensation device which is capable of revolving an orbiting-scroll in a θ direction by way of a main frame. An optimum angle of the fixed-scroll relative to the orbiting-scroll and an optimum wrap clearance are determined at the same time while orbitally moving the orbiting-scroll. Thereby, alignment of a scroll compression section is performed in a short time with a high precision including positioning of a rotating direction of the fixed-scroll relative to the orbiting-scroll.

8 Claims, 10 Drawing Sheets

APPARATUS FOR ALIGNING SCROLL COMPRESSOR

TECHNICAL FIELD

The present invention relates to an apparatus for aligning a scroll compressor, and more detailedly a technique configured to be capable of aligning a fixed-scroll and an orbiting-scroll in a short time and with a high precision.

BACKGROUND ART

Japanese Patent Laid-Open No. 62-203901 (prior art 1) discloses a method for aligning a scroll compressor by bringing a fixed-scroll and an orbiting-scroll into mesh with each other for temporal positioning, performing an orbital motion of the orbiting-scroll relative to the fixed-scroll at a temporal position by orbiting-scroll orbiting means, slightly moving the fixed-scroll in X and Y directions by a fixed-scroll movable means, detecting positions on + and − sides at which a scrolled wrap side surface of the orbiting-scroll is in contact with a scrolled-wrap side surface of the fixed-scroll in X and Y directions respectively by orbiting-scroll displacement detecting means, inputting detection date into calculation control means, calculating an intermediate value of contact positions data on each of the + and − sides and positioning the fixed-scroll by correcting positions of the fixed-scroll in the X and Y directions respectively on the basis of a calculation result.

Furthermore, Japanese Patent No. 2811715 (prior art 2) proposes a method for aligning a scroll compressor by bringing a fixed-scroll and an orbiting-scroll into mesh with each other, revolving the orbiting-scroll consecutively at 0°, 90°, 180° and 270° with a bearing of the orbiting-scroll fixed in a condition where an assembling contact surfaces of the fixed-scroll and the orbiting-scroll are in contact with each other, moving the fixed-scroll toward a revolving center until the fixed-scroll comes into contact with the orbiting-scroll at each revolving position of the orbiting-scroll, determining X and Y ordinates when the fixed-scroll comes into contact with the orbiting-scroll, determining a center of an ordinate from X and Y ordinates detected at each revolving position, and adopting the center as a center to position the fixed-scroll and the orbiting-scroll.

However, the above described prior art 1 is configured to align the scroll compressor in the condition where the fixed-scroll is a little raised from the orbiting-scroll, whereby the prior art 1 may allow an error to be involved when the fixed-scroll is lowered and assembled with the orbiting-scroll after alignment.

Furthermore, the prior art 1 requires a time for the alignment since the prior art 1 is configured to perform fine adjustment after the fixed-scroll is slightly moved in the directions of the X axis and the Y axis for the temporal positioning. Furthermore, the prior art 1 may distribute ununiform gaps on left and right sides of wraps since this art does not consider the positioning of the fixed-scroll and the orbiting-scroll relative to each other in a revolving direction.

The above described prior art 2 also requires a time for alignment since the prior art 2 measures coordinate axes with the fixed-scroll and the orbiting-scroll stopped at orbital angle intervals of 90°. Furthermore, the prior art 2 may distribute ununiform gaps on left and right sides of wraps since the prior art 2 does not consider the positioning of the fixed-scroll and the orbiting-scroll relative to each other in a revolving direction like the prior art 1.

SUMMARY OF THE INVENTION

According to the present invention, it is possible to align a scroll compressing section in a short time and with a high precision including positioning of a fixed-scroll and an orbiting-scroll relative to each other in a revolving direction. Accordingly, the present invention have several characteristics which are described below.

First of all, a first invention provides an apparatus for aligning a scroll compressor comprising a fixed-scroll and an orbiting-scroll which are composed of erect spiral scroll-wraps formed on base plates respectively and internally form a compressing chamber by bringing the scroll-wraps into mesh with each other, and a main frame having a driving shaft for the orbiting-scroll: the orbiting-scroll being accommodated in the main frame so as to be capable of performing an orbital motion by way of an oldham coupling, characterized in that apparatus comprises X-Y optionally movable means which is restricted to rotate in a θ direction around a Z axis and supports the fixed-scroll so as to be optionally movable in directions of an X axis and a Y axis, fixed-scroll movable means for moving the fixed-scroll at least in the directions of the X axis and the Y axis by way of the X-Y optionally movable means, orbiting-scroll revolution compensation means which is restricted to rotate the directions of the X axis and the Y axis, and supports the orbiting-scroll in the θ direction around the Z axis by way of the main frame, orbiting-scroll driving means which is coupled with the driving shaft and drives the orbiting-scroll, fixed-scroll displacement detecting means for detecting moving displacements of the fixed-scroll in the directions of the X axis and the Y axis caused due to an orbital motion of the orbiting-scroll and control means which performs predetermined calculations on the basis of a detection signal from the fixed-scroll displacement detecting means, and controls the orbiting-scroll revolution compensation means and the fixed-scroll movable means, and that the above described control means controls orbiting-scroll revolution compensation means so as to minimize a moving displacement of the fixed-scroll with a detection signal obtained from the displacement detecting means when the orbiting-scroll is revolved in the θ direction by the orbiting-scroll revolution compensation means in a condition where the orbiting-scroll is subjected to a continuous orbital motion by the orbiting-scroll driving means, moves the fixed-scroll in the directions of the X axis and the Y axis respectively by the fixed-scroll movable means by way of the X-Y optionally movable means, and determines an intermediate value of a wrap clearance with a detection signal obtainable from the displacement detecting means when the fixed-scroll is pushed back by the orbiting-scroll, thereby compensating a position of the fixed-scroll.

The apparatus according to the present invention is capable of managing both alignment in directions of the X axis and the Y axis (an XY compensation) and alignment of the orbiting-scroll and the fixed-scroll relative to each other in a revolving direction (a revolution compensation) at the same time and with a high precision.

When the apparatus according to the present invention further comprises fixed-scroll raising-lowering means for moving the fixed-scroll in the direction of the Z axis, the apparatus is capable of compensating a load of the fixed-scroll on the orbiting-scroll at an assembling time of a scroll compressor in addition to the XY compensation and revolution compensation.

In a preferable aspect of the present invention, the X-Y optionally movable means comprises a first support plate disposed on a side of the fixed-scroll movable means, a second support plate for supporting the fixed-scroll and an intermediate plate disposed between the first and second support plates, the first support plate is coupled with the intermediate plate using a pair of first leaf springs which are elastically deformable only in either direction of the X axis or the Y axis and arranged in parallel with each other, and the second support plate is coupled with the intermediate plate using a pair of second leaf springs which are elastically deformable only in other direction of the X axis or the Y axis and arranged in parallel with each other.

The apparatus having this configuration is capable of optionally moving the fixed-scroll in the directions' of the X axis and the Y axis while restricting the fixed-scroll to revolve in the θ direction, and pushing back the fixed-scroll to an initial condition even when the fixed-scroll is moved.

In another aspect of the present invention, the apparatus may have a configuration wherein the X-Y optionally movable means comprises the first support plate disposed on the side of the fixed-scroll movable means, the second support plate for supporting the fixed-scroll and the intermediate plate disposed between the first and second support plates, the first support plate is coupled with the intermediate plate using a first linear guider which can slide in the direction of either one of the X axis and Y axis, and the second support plate is coupled with the intermediate plate using a second linear guider which can slide only in the direction of the other of the X axis and the Y axis. As a representative example of the linear guider, there can be mentioned a combination of a key groove and a guide rail which engages with the key groove.

As detecting means for detecting a displacement of the fixed-scroll, there are various kinds of sensors such as contact type, contactless type or the like, and it is preferable in particular that the displacement detecting means consists of the contactless type displacement sensor. A distance sensor using a laser beam can be mentioned as the contactless type displacement sensor.

The distance sensor is capable of accurately measuring a displacement of the fixed-scroll without applying an external force to the fixed-scroll. The displacement detecting means may be a strain sensor attached to each leaf spring described above.

Then, a second invention in the present invention provides a method for aligning a scroll compressor comprising a fixed-scroll and an orbiting-scroll which are composed of erect spiral scrolled-wraps formed on base plates respectively and internally form a driving chamber by bringing the scrolled-wraps with each other, and a main frame having a driving shaft for the orbiting-scroll: the orbiting-scroll being accommodated in the main frame so as to be capable of performing an orbital movement, characterized in that a side of the main frame is set in a condition in which the main frame is rotatable only in a θ direction around a Z axis while being restricted to rotate in directions of an X axis and a Y axis, and a side of the fixed-scroll is set in a condition where the fixed-scroll is optionally rotatable in the directions of the X axis and the Y axis while being restricted to rotate in the θ direction around the Z axis first for aligning for the revolution compensation in alignment for aligning the fixed-scroll and the orbiting-scroll relative to each other in a revolving direction (a revolution compensation), that the main frame is rotated in the θ direction while revolving the orbiting-scroll by way of the driving shaft and that a rotating angle of the main frame in the θ direction is adjusted so as to minimize a moving displacement of the fixed-scroll at that time.

In order to determine a compensation position at this revolution compensation time, when a rotating angle which minimizes a moving displacement amount of the fixed-scroll at a rotation time of the main frame in a positive direction is denoted by θ1 and a rotating angle which minimizes a moving displacement of the fixed-scroll at a rotation time in a negative direction is denoted by θ2 by setting a rotating angle of the main frame at (θ1+θ2)/2, it is possible to determine a rotating position of the fixed-scroll relative to that of the orbiting-scroll at which a highest compression efficiency is obtained.

As another method, it is possible to denote an initial displacement of the fixed-scroll caused by revolving the orbiting-scroll by W, denote a radius of a basic circle of the orbiting-scroll by a, calculate a revolution compensation angle θb by an equation $$[\{W/2a\}/\pi]\times 180^\circ$$

and adjust a rotating angle of the main frame in the θ direction to the revolution compensation angle θ.

After having adjusted the rotating angle of the main frame in the θ direction (revolution compensation), it is possible to obtain maximum displacements (wrap clearances) of the fixed scroll in the directions of the X axis and the Y axis respectively at the time when the fixed-scroll is pushed back by the orbiting-scroll by moving the fixed-scroll to the directions of the X axis and the Y axis, and it is also possible to execute the XY compensation in X and Y directions in addition to the revolution compensation by moving the fixed-scroll to an intermediate position between the maximum displacements.

In addition to the revolution compensation and the XY compensation, an error can be prevented from being involved at an assembling stage of the scroll compressor by moving the fixed-scroll in the direction of the Z axis and further adjusting a position of the fixed-scroll in the direction of the Z axis so as to make a load of the fixed-scroll on the orbiting-scroll to be substantially zero.

DETAILED DESCRIPTION OF THE PREFERRED EMBODIMENTS

Now, an embodiment of the present invention will be described with reference to the accompanying drawings. In the present invention, an axial center of a driving shaft of an orbiting-scroll is taken as an origin of an XYZ coordinate system, an axial direction of the driving shaft is taken as a Z axis, XY is taken as an optional orthogonal coordinate system perpendicular to the Z axis, and a rotating direction around the Z axis is taken as θ.

Figure 1:
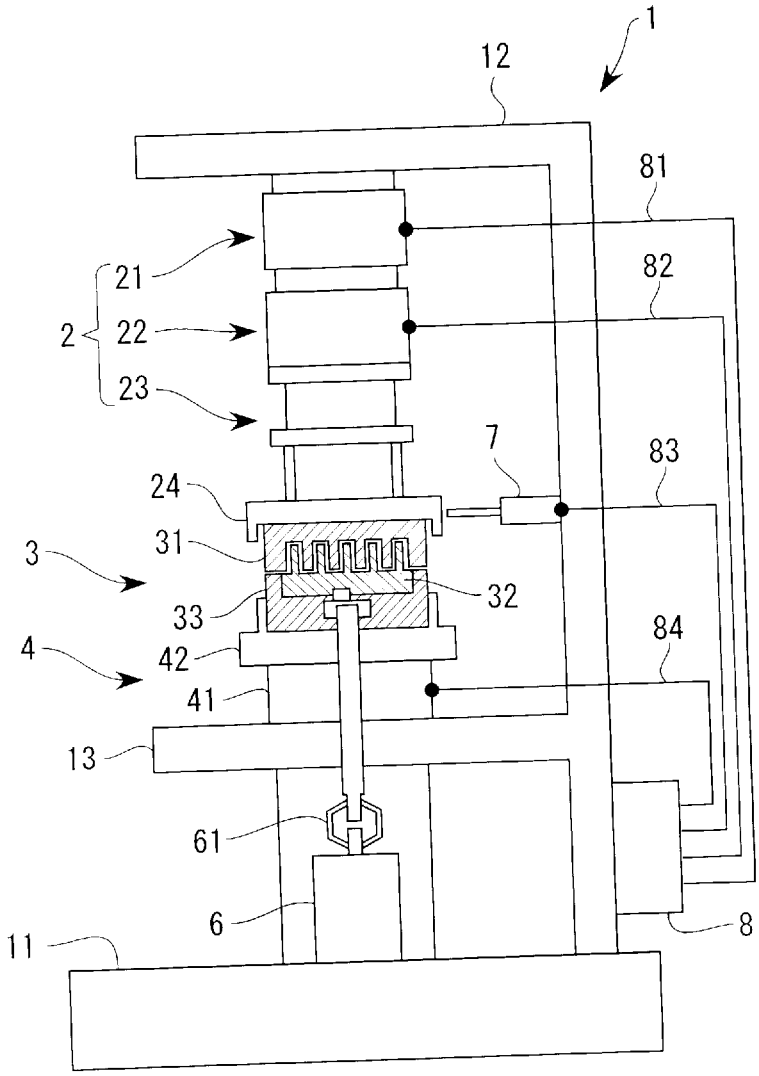
FIG. 1 is a front view showing an embodiment of an apparatus for aligning a scroll compressor according to the present invention.

As shown in FIG. 1, an aligning apparatus 1 according to the present invention comprises a base stand 11 which consists of a solid plate body made of a metal or the like and an L-shaped support frame 12 which is erected perpendicularly from the base stand 11. Disposed on a portion protruding from an upper section of the inverted-L shaped frame 12 is fixed-scroll movable means 2 which supports a fixed-scroll 31 of a scroll compressor 3 so as to be movable in directions of the X axis and the Y axis.

Disposed on an intermediate stage 13 of the support frame 12 is orbiting-scroll revolution compensation means 4 which supports a side of a main frame 33 of the scroll compressor 3 so as to be rotatable in the θ direction. Furthermore, disposed on the base stand 11 is a motor 6 which is to be coupled selectively with a driving shaft 5 of an orbiting-scroll 32 by way of a chuck 61.

Disposed on a side wall surface of the support frame 12 is calculating means 8 which measures, calculates and outputs detection data sent from each detecting means. An operation panel or the like (not shown) is assembled in the calculating means 8 so that a precision, an aligning time and the like can be controlled by optionally inputting setting values and the like.

In this embodiment, the fixed-scroll movable means 2 comprises, Z axis movable means 21, X-Y movable means 22 and X-Y optionally movable means 23 in order from upside, and a fixed section 24 of a fixed-scroll 31 is disposed on a side of a lower end of the X-Y optionally movable means 23.

In the fixed-scroll movable means 2, the θ direction around the Z axis is restricted, and the fixed-scroll 31 can be optionally moved in directions of an X axis, a Y axis and the θ direction around the z axis, and is capable of moving the fixed-scroll optionally in directions of an X axis, a Y axis and the Z axis.

The Z axis movable means 21 is, so called, raising-lowering means for moving the fixed-scroll 31 in an up-down direction and load detecting means such as a load cell (not shown) is disposed inside or outside the Z axis movable means 21. This Z axis movable means 21 is connected to the calculating means 8 by way of a signal line 81 and driven by a command from the calculating means 8.

The X-Y movable means 22 is movable means which is restricted to rotate in the θ direction around the Z axis, and moves the fixed-scroll 31 only in the directions of the X and Y axes. A driving mechanism (not shown) is built in the X-Y movable means 22 and driven with a control signal provided from the calculating means 8 by way of a signal line 82.

Figure 2:
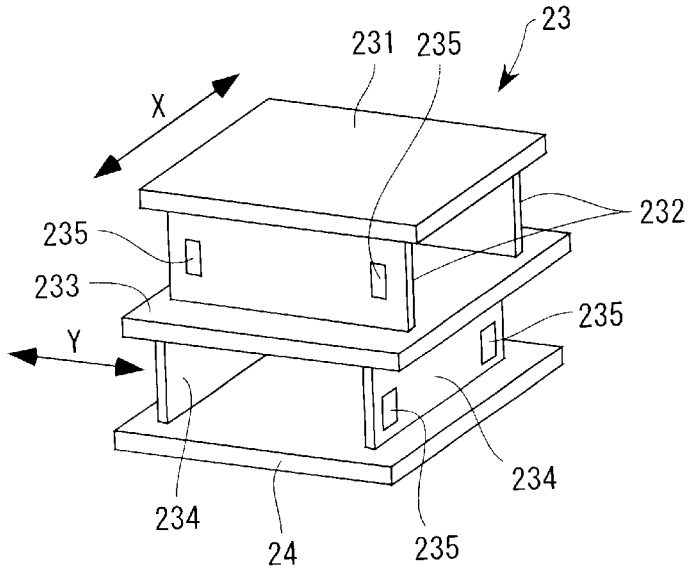
FIG. 2 is a perspective view showing X-Y optionally movable means applied to the above described embodiment.

As shown in FIG. 2, the X-Y optionally movable means 23 comprises a first support plate 231, a second support plate (fixed member) 24 for supporting the fixed-scroll 31, and an intermediate plate 233 disposed between the first support plate 231 and the second support plate 24 which are disposed on a side of the fixed-scroll movable means 2.

The first support plate 231 is coupled with the intermediate plate 233 using a pair of first leaf springs 232 and 232 which are elastically deformable only in the direction of the X axis and disposed in parallel with each other, and the intermediate plate 233 is coupled with the second support plate 24 using a pair of second leaf springs 234 and 234 which are elastically deformable only in the direction of the Y axis and disposed in parallel with each other.

Figure 3:
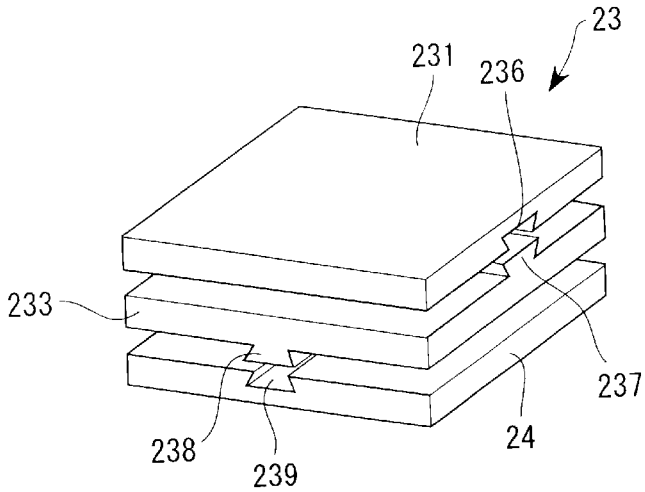
FIG. 3 is a perspective view exemplifying a modification of the X-Y optionally movable means.

As a modification example of the X-Y optionally movable means 23, linear guiders which can slide in the directions of the X axis and the Y axis may be disposed as shown in FIG. 3 for coupling the first support plate 231 with the intermediate plate 233 and coupling the intermediate plate 233 with the second support plate 24.

In other words, the first support plate 231 is coupled with the intermediate plate 233 by forming a key groove 236 on a side of the first support plate 231 and forming a guide rail 237 matched in a form with the key groove 236 on a side of the intermediate plate 233.

Similarly, the intermediate plate 233 may be coupled with the second support plate 24 by forming a key 238 on a side of a bottom surface of the intermediate plate 233 and forming a guide rail 239 matched in a form with the key 238 on a side of the second support plate 24.

Though only one shown in FIG. 1, displacement sensors 7 for measuring displacements of the fixed section (second support plate) 24 are disposed on both side surfaces of the fixed section 24 in the X and Y directions respectively. The displacement sensors 7 are connected to the calculating means 8 by way of a signal line 83 for outputting detection data obtained with the displacement sensors 7 to the calculating means 8.

It is preferable that the displacement sensor 7 is a contactless type sensor and there can be mentioned for example, a distance sensor which measures a distance to the fixed section 24 with a laser.

Usable as other detecting means are strain sensors 235 which are attached to side surfaces of the leaf springs 232 and 234 of the X-Y optionally movable means 23 such as those described with reference to FIG. 2 for measuring strain applied to the leaf springs 232 and 234, and this aspect is also included within a scope of the present invention.

The scroll compressor 3 comprises the fixed-scroll 31 and the orbiting-scroll 32 having scrolled-wraps in mesh with each other, and the orbiting-scroll 32 is held in the main frame 33 by way of a rotation-preventive oldham coupling (not shown). A driving shaft 5 runs through the main frame 33 and is held therein for coupling with the orbiting-scroll 32. A crankshaft 51 which causes an orbital motion of the orbiting-scroll 32 is disposed at an end of the driving shaft 5.

The orbiting-scroll revolution compensation means 4 comprises a main frame holder 42 for holding the main frame 33 and θ rotation means 41 which is capable of rotating the main frame holder 42 in the θ direction around the Z axis.

The orbiting-scroll revolution compensation means 4 is restricted to move in the directions of the X axis and the Y axis, and capable of rotating in the θ direction. θ rotating means 41 is connected to the calculating means 8 by way of a signal line 84 and driven with a command sent from the calculating means 8.

Figure 4:
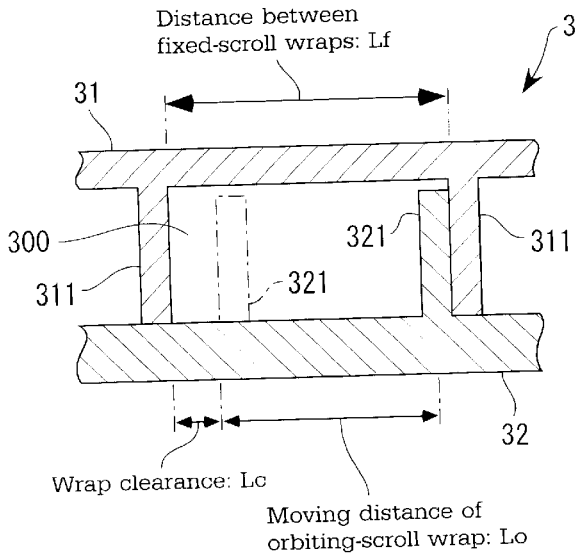
FIG. 4 is a schematic diagram descriptive of a wrap clearance between a fixed-scroll and an orbiting-scroll.

When a distance between fixed scrolled-wraps 311 of the fixed-scroll 31 which are adjacent to each other is denoted by Lf, and an orbital moving distance of an orbiting scrolled-warp 321 of the orbiting-scroll 32 is denoted by Lo as shown in FIG. 4, a value Lc expressed as Lf−Lo=Lc is a wrap clearance, and aligning apparatus according to the present invention aligns the fixed-scroll 31 and the orbiting-scroll 32 so that the wrap clearance Lc is appropriate.

Figure 5:
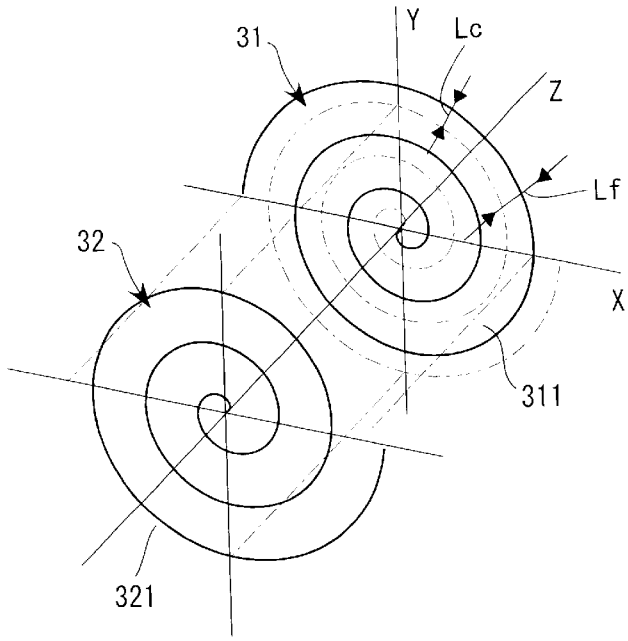
FIG. 5 is a schematic diagram showing an optimum relative angle of the fixed-scroll relative to the orbiting-scroll.

Alignment is performed at two divided steps for the revolution compensation and the XY compensation. First, the revolution compensation is performed for compensating an angle of fixed-scroll 31 relative to the orbiting-scroll 32. In a most preferable condition, the fixed-scroll 31 has an angle of 180° relative to the orbiting-scroll 32 as shown in FIG. 5.

Figure 6A:
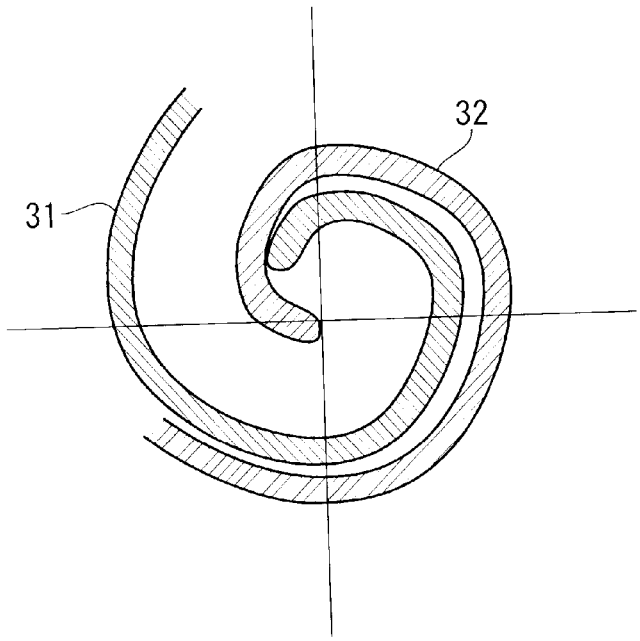
FIGS. 6A and 6B are schematic diagrams descriptive of a reason for a necessity of a revolution compensation.
Figure 6B:
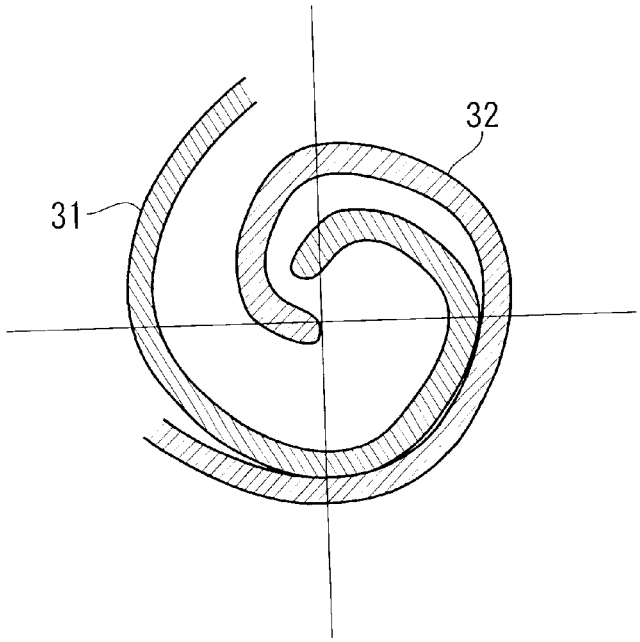

When a relative angle between the scrolls 31 and 32 is deviated from 180° as shown in FIG. 6A, however, the scrolls 31 and 32 interfere with each other as shown in FIG. 6B as the orbiting-scroll orbitally moves, thereby rotating a center of the fixed-scroll 31.

In a condition where the X-Y movable means 22 is turned off and the fixed-scroll 31 is free to move in the directions of the X axis and the Y axis by the X-Y optionally movable means 23, displacements X1 and Y1 of the fixed-scroll 31 in the directions of the X axis and the Y axis respectively are measured while orbitally revolving the orbiting-scroll 32 by the motor 6. Initial displacements at this time are denoted by X1 and Y1.

Figure 7:
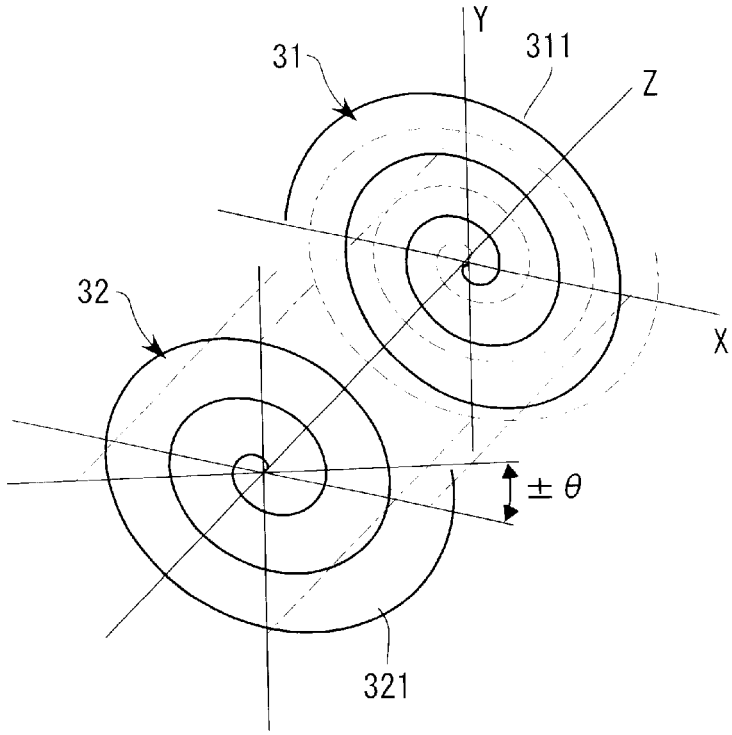
FIG. 7 is a schematic diagram showing a condition where the orbiting-scroll is revolved in the θ direction at a revolution compensation time.

Then, a side of the main frame 33 is rotated θ° in the + direction as shown in FIG. 7 by the θ° rotating means 41 of the orbiting-scroll revolution compensation means 4, thereby determining a rotating angle θ1 which minimizes the displacements of the fixed-scroll 31 in the directions of the X axis and the Y axis.

Then, the side of the main frame 33 is rotated θ° in the − direction from the position rotated θ° in the + direction, thereby determining a rotating angle θ2 which minimizes displacements of the fixed-scroll 31 in the directions of the X axis and the Y axis at this time.

Figure 8:
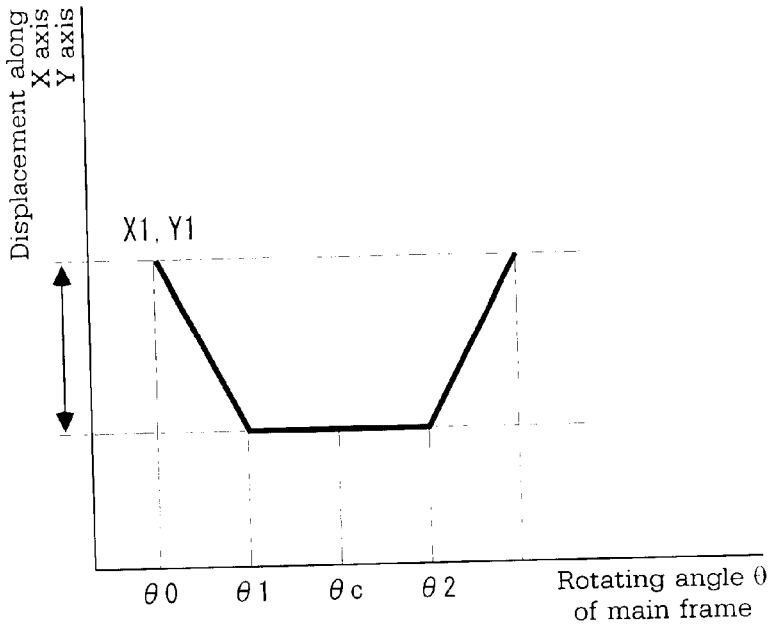
FIG. 8 is a schematic diagram descriptive of the optimum relative angle.

FIG. 8 is a graph showing a correlation between a rotating angle θ of the main frame 33 and a displacement of the fixed-scroll 31 which are obtained at the time of this revolution compensation. The above described rotating angles θ1 and θ2 are outermost points of a region within which the wraps do not interfere with each other in the X and Y directions, and an intermediate value (θ1+θ2)/2=θc is therefore an optimum revolution compensation angle.

This series of calculating processings are performed by the calculating means 8 and the θ revolving means 41 is controlled to a θc revolving position by the calculating means 8, thereby terminating a relative revolution compensating work between the fixed-scroll 31 and the orbiting-scroll 32.

In addition, it is possible as another revolution compensation method to determine a revolution compensation angle θb from an initial displacement W of the fixed-scroll 31 per revolution of the orbiting-scroll 32 and a basic circle radius a of the orbiting-scroll 32.

That is, the revolution compensation angle θb can be determined by an equation $[\{W/2a\}/\pi]\times 180°$ and a moving displacement of the fixed-scroll can be minimized by adjusting a revolving angle of the main frame 33 to this revolution compensation angle θb.

Then, a warp clearance Lc between the fixed-scroll wrap 311 and the orbiting-scroll wrap 321 is determined, and the fixed-scroll 31 is moved to an intermediate point of the wrap clearance Lc for distributing the warp clearance Lc evenly on left and right sides of wraps as the XY compensation.

Figure 9A:
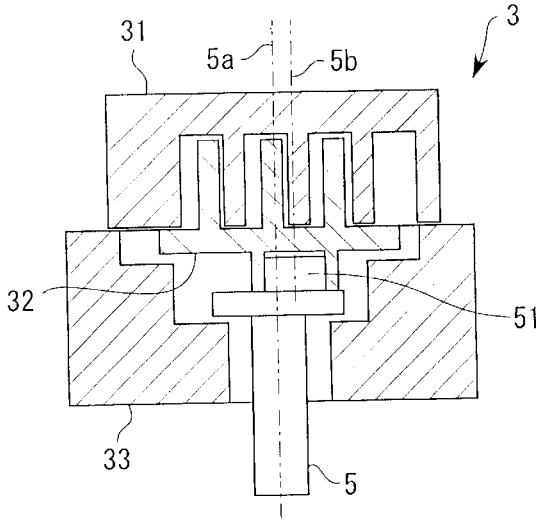
FIGS. 9A and 9B are schematic diagrams descriptive of a relative relation between a driving shaft and an orbiting shaft of the orbiting-scroll.
Figure 9B:
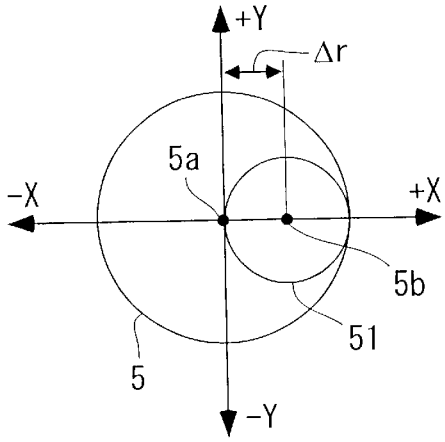

An orbiting shaft 51 which causes an orbital motion of the orbiting-scroll 32 is disposed so as to be eccentric for a distance Δr from an axial center 5*a* of the driving shaft 5 as shown in FIG. 9A. Accordingly, the orbiting shaft 51 revolves around the axial center 5*a* of the driving shaft 5 while revolving the orbiting-scroll 32 as shown in FIG. 9B.

In determining the wrap clearance Lc, the calculating means 8 detects whether the orbiting shaft 51 is located on a positive or negative side on an X-Y coordinate using as an origin the axial center 5*a* of the driving shaft 5.

Figure 10A:
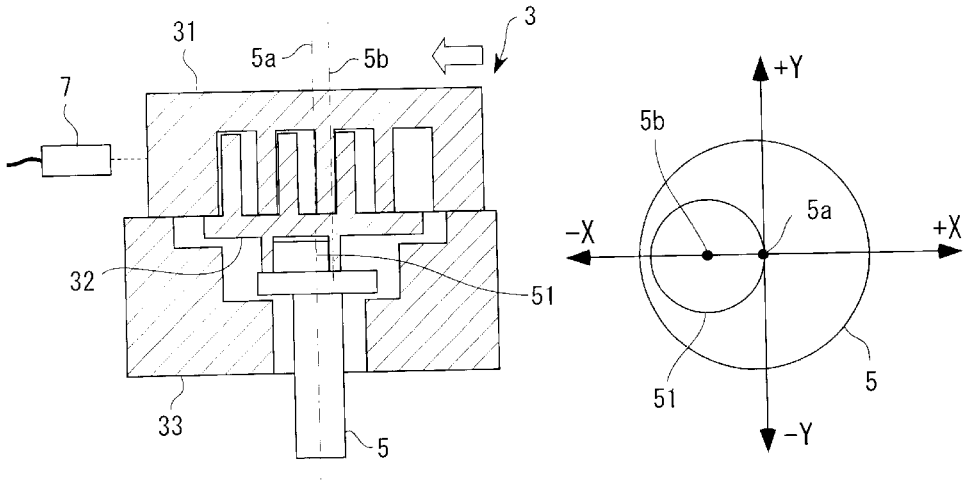
FIGS. 10A and 10B are schematic diagrams showing a condition where the fixed-scroll is moved in a −Δ direction to determine the wrap clearances in the directions of an X axis and a Y axis.

Describing a case where the wrap clearance Lc in the direction of the X axis is to be determined, the X-Y movable means 22 is first moved for −ΔX so that the fixed-scroll 31 follows the orbiting-scroll 32 located on a −X side by way of the X-Y optionally movable means 23 when the orbiting shaft 51 is moved on the −X side as seen from the axial center 5*a* of the driving shaft 5 as shown in FIG. 10A.

In addition, a moving distance ΔX of the X-Y movable means 22 is assumed to have a value larger than the wrap clearance Lc. A motion of the X-Y movable means 22 toward the −X side is allowed by the X-Y optionally movable means 23.

Figure 10B:
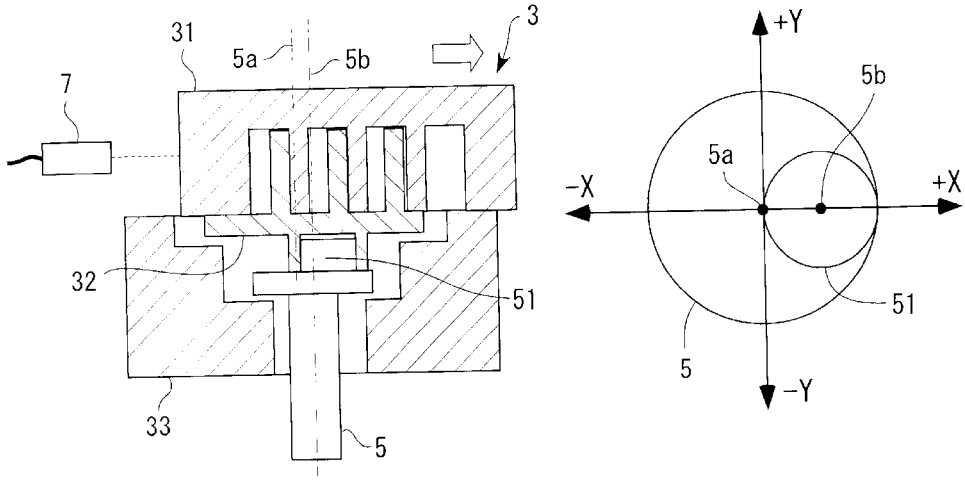

When the orbiting shaft 51 moves to the +X side as seen from the axial center 5*a* of the driving shaft 5 as shown in FIG. 10B, the fixed-scroll wrap 311 comes into contact with the orbiting-scroll wrap 321, whereby the fixed-scroll 31 is pushed back on the +X side by the orbiting-scroll 32. A displacement on the +X side is read by the displacement sensor 7 as a maximum displacement X1.

Figure 11A:
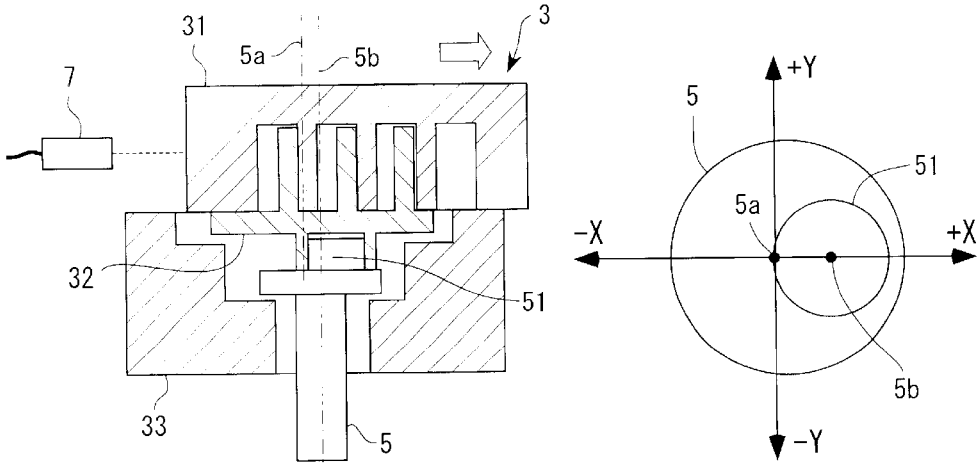
FIGS. 11A and 11B are schematic diagrams showing a condition where the fixed-scroll is moved in a +Δ direction in the directions of the X axis and the Y axis from the condition shown in FIG. 10A and FIG. 10B.

When the orbiting shaft 51 is moved on the +X side as seen from the axial center 5*a* of the driving shaft 5 as shown in FIG. 11A, the X-Y movable means 22 is moved for +ΔX so that the fixed-scroll 31 follows the orbiting-scroll 32 located on the +X side by way of the X-Y optionally movable means 23.

Figure 11B:
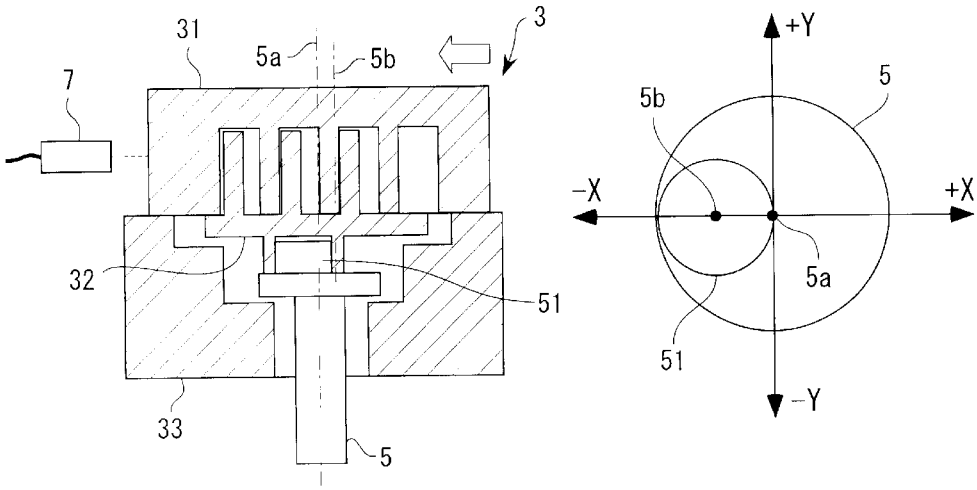

When the orbiting shaft 51 is moved on the −X side as seen from the axial center 5*a* of the driving shaft 5 thereafter as shown in FIG. 11B, the fixed-scroll wrap 311 comes into contact with the orbiting-scroll wrap 321, whereby the fixed-scroll 31 is pushed back on the −X side by the orbiting-scroll 32. A displacement on the −X side is read by the displacement sensor 7 as a maximum displacement X.

Figure 12:
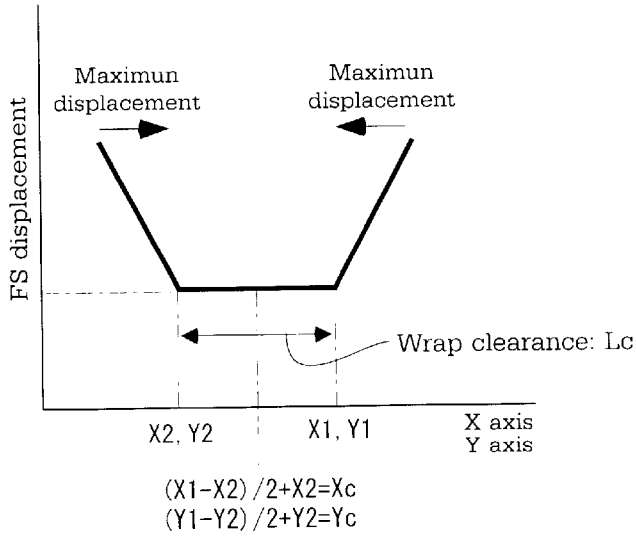
FIG. 12 is a schematic diagram descriptive of wrap clearance positions in the directions of the X and Y axes.

FIG. 12 is a graph showing maximum displacements of the fixed-scroll 31 in the + and − directions taking the direction of the X axis as an abscissa. A distance between X1 and X2 is the wrap clearance Lc on this graph, and the wrap clearance Lc can be distributed evenly between left and right sides of the wraps by positioning the fixed-scroll 31 at an intermediate value (X1+X2)/2=Xc of the wrap clearance Lc. In the direction of the Y axis also, the XY compensation is completed by performing similar operations.

The present invention has been detailedly described with reference to a specific aspect, but a scope of the present invention described as claims is to include modifications, alterations and equivalent techniques which can easily be made by those skilled in the art who have understood contents of the foregoing description.

As described above, the present invention makes it possible to perform alignment of a scroll compressor in a short time and with a high precision including positioning of a fixed-scroll and an orbiting-scroll relative to each other in a revolving direction.

What is claimed is:

1. An apparatus for aligning a scroll compressor, including: a fixed-scroll and an orbiting-scroll composed of erect spiral scrolled-wraps formed on base plates respectively and internally forming a driving chamber by bringing the scrolled-wraps in mesh with each other; and a main frame having a driving shaft of said orbiting-scroll, said orbiting-scroll being accommodated in said main frame so as to be capable of performing an orbital motion by way of an oldham coupling, wherein said apparatus comprises:

Y X-Y optionally movable means which is restricted to rotate in a θ direction around a Z axis, and supports said fixed-scroll so as to be optionally movable in directions of an X axis and a Y axis;

fixed-scroll movable means for moving said fixed-scroll at least in the directions of the X axis and the Y axis by way of said X-Y optionally movable means;

orbiting-scroll revolution compensation means which is restricted to move in the directions of the X axis and the Y axis, and supports said orbiting-scroll so as to be revolvable in the θ direction around the Z axis by way of said main frame;

orbiting-scroll driving means which is coupled with said driving shaft and drives said orbiting-scroll;

fixed-scroll displacement detecting means for detecting moving displacements of said fixed-scroll in the directions of the X axis and the Y axis caused due to the orbital motion of said orbiting-scroll; and control means for performing predetermined calculations on the basis of a detection signal from said fixed-scroll displacement detecting means, thereby controlling said orbiting-scroll revolution compensation means and said fixed-scroll movable means, and said control means controls said orbiting-scroll revolution compensation means so as to minimize a moving displacement of said fixed-scroll with a detection signal obtained from said displacement detecting means when said orbiting-scroll is revolved in the θ direction by said orbiting-scroll revolution compensation means; moves said fixed-scroll in the directions of the X axis and the Y axis respectively by said fixed-scroll movable means by way of said X-Y optionally movable means; determines an intermediate value of a wrap clearance with a detection signal obtained from said displacement detecting means when said fixed-scroll is pushed back by said orbiting-scroll; and compensates a position of said fixed-scroll in a condition where said orbiting-scroll is subjected to a continuous orbital motion by said orbiting-scroll driving means.

2. The apparatus for aligning a scroll compressor according to claim 1, further comprising fixed-scroll raising-lowering means for moving said fixed-scroll in a direction of the Z axis.

3. The apparatus for aligning a scroll compressor according to claim 1, wherein said X-Y optionally movable means comprises a first support plate disposed on a side of said fixed-scroll movable means, a second support plate for supporting said fixed-scroll and an intermediate plate disposed between the first support plate and the second support plate, said first support plate is coupled with said support intermediate plate using a pair of first leaf springs which are elastically deformable only in either direction of the X axis or the Y axis and arranged in parallel with each other, and said second support plate is coupled with said intermediate plate using a pair of second leaf springs which are elastically deformable only in the other direction of the X axis or the Y axis and arranged in parallel with each other.

4. The apparatus for aligning a scroll compressor according to claim 1, wherein said X-Y optionally movable means comprises a first support plate disposed on a side of said fixed-scroll movable means, a second support plate for supporting said fixed-scroll and an intermediate plate disposed between the first support plate and the second support plates, said first support plate is coupled with said intermediate plate using a first linear guider which can slide only in either direction of the X axis or the Y axis, and said second support plate is coupled with said intermediate plate using a second linear guider which can slide only in the other direction of the X axis or the Y axis.

5. The apparatus for aligning a scroll compressor according to claim 4, wherein each of said first and second linear guiders includes a key groove and a guide rail engaging with said key groove.

6. The apparatus for aligning a scroll compressor according to any one of claim 1, wherein said displacement detecting means is a contactless type displacement sensor.

7. The apparatus for aligning a scroll compressor according to claim 6, wherein said contactless type displacement sensor is a distance sensor using a laser beam.

8. The apparatus for aligning a scroll compressor according to claim 3, wherein said displacement detecting means is a strain sensor attached to each of said leaf springs.

* * * * *